US009932990B2

(12) United States Patent
Schöne et al.

(10) Patent No.: US 9,932,990 B2
(45) Date of Patent: Apr. 3, 2018

(54) VENTILATION DEVICE, IN PARTICULAR FOR HEATING, COOLING, AND/OR HUMIDIFYING AIR IN RESIDENTIAL BUILDINGS

(71) Applicant: ebm-papst Mulfingen GmbH & Co. KG, Mulfingen (DE)

(72) Inventors: Jürgen Schöne, Bad Mergentheim (DE); Christian Haag, Künzelsau (DE); Katrin Bohl, Künzelsau (DE); Thorsten Pissarczyk, Gemmingen (DE); Marc Schneider, Dörzbach (DE); Björn Sudler, Boxberg Schwabhausen (DE); Jens Müller, Künzelsau (DE); Michael Strehle, Ingelfingen (DE); Oliver Haaf, Künzelsau (DE); Erhard Gruber, Satteldorf (DE); Christian Hammel, Pfedelbach-Oberohm (DE); Eric Reichert, Boxberg (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 712 days.

(21) Appl. No.: 14/163,590

(22) Filed: Jan. 24, 2014

(65) Prior Publication Data

US 2014/0209275 A1 Jul. 31, 2014

Related U.S. Application Data

(60) Provisional application No. 61/757,417, filed on Jan. 28, 2013.

(30) Foreign Application Priority Data

Mar. 15, 2013 (EP) ..... 13159536

(51) Int. Cl.
*F04D 29/66* (2006.01)
*F24F 7/06* (2006.01)
(Continued)

(52) U.S. Cl.
CPC ..... *F04D 29/663* (2013.01); *F04D 29/541* (2013.01); *F04D 29/703* (2013.01);
(Continued)

(58) Field of Classification Search
CPC ..... F04D 29/54; F04D 29/541; F04D 29/663; F04D 29/703; F24F 7/06; F24F 13/10; F24F 2013/088
(Continued)

(56) References Cited

U.S. PATENT DOCUMENTS 6,534,946 B2 * 3/2003 Lelkes ..... H02P 1/46 310/67 R
7,744,342 B2 6/2010 Kamoshita et al.
(Continued)

FOREIGN PATENT DOCUMENTS

DE 1052624 B * 3/1959 ..... F24F 13/08
DE 30 10 071 A1 3/1980
(Continued)

OTHER PUBLICATIONS

Author: Google Title: Google translation of document EP0547253 Date Accessed (mm/dd/yyyy): Apr. 14, 2017 Link: https://www.google.com/patents/EP0547253A1?cl=de.*

*Primary Examiner* — Dominick L Plakkoottam
*Assistant Examiner* — Chirag Jariwala
(74) *Attorney, Agent, or Firm* — Brinks Gilson & Lione

(57) ABSTRACT

A ventilation device, in particular for heating, cooling and/or humidifying air in residential buildings, includes a duct-shaped housing (1) with an air inlet opening (2) and an air outlet opening (3), and a fan impeller (6) as well as a filter
(Continued)

unit, heat exchange unit and/or heating coil unit (14) arranged in the main flow direction (Z) of an air flow generated by the fan impeller (6). An air guiding device (17) is arranged in the flow direction (Z) of the air flow in front of a suction nozzle (16)—configured as a flow conditioner, includes a bar structure with air guiding bars-such that a flow inlet opening is configured on the suction side at an axial height in front of the flow inlet opening (15) by the bar structure whose opening surface is smaller than the opening surface of the flow inlet opening (15).

26 Claims, 10 Drawing Sheets

(51) Int. Cl.

| | |
|---|---|
| ***F24F 13/10*** | (2006.01) |
| ***F04D 29/54*** | (2006.01) |
| ***F04D 29/70*** | (2006.01) |
| *F24F 13/08* | (2006.01) |

(52) U.S. Cl.
CPC ..... *F24F 7/06* (2013.01); *F24F 13/10* (2013.01); *F24F 2013/088* (2013.01)

(58) Field of Classification Search
USPC ..... 417/423.14
See application file for complete search history.

(56) References Cited

U.S. PATENT DOCUMENTS

| | | | | |
|---|---|---|---|---|
| 8,849,463 | B2 * | 9/2014 | Hopkins | F04D 25/166 700/276 |
| 2008/0247868 | A1 * | 10/2008 | Lan | F04D 29/326 415/182.1 |
| 2011/0150632 | A1 * | 6/2011 | Heli | B01D 46/001 415/121.2 |
| 2011/0211963 | A1 * | 9/2011 | Bohl | F04D 29/162 416/179 |
| 2013/0216407 | A1 * | 8/2013 | Rasmussen | F04D 15/0033 417/410.1 |

FOREIGN PATENT DOCUMENTS

| | | | | |
|---|---|---|---|---|
| DE | 32 41 860 | C3 | 11/1982 | |
| EP | 0547253 | A1 * | 6/1993 | F04D 29/541 |
| EP | 1 924 772 | B1 | 9/2006 | |
| EP | 1895166 | A1 | 3/2008 | |
| EP | 2123917 | A2 | 11/2009 | |
| EP | 2196739 | A1 * | 6/2010 | F04D 29/703 |
| FR | 2763367 | A1 | 11/1998 | |
| GB | 1 256 625 | | 1/1969 | |
| GB | 2088953 | A | 6/1982 | |
| JP | 57088292 | A | 6/1982 | |
| JP | 60130114 | U | 8/1985 | |
| JP | 2003130396 | A * | 5/2003 | F04D 29/667 |
| JP | 2004251151 | A * | 9/2004 | |
| JP | 2006194102 | A | 7/2006 | |

* cited by examiner

VENTILATION DEVICE, IN PARTICULAR FOR HEATING, COOLING, AND/OR HUMIDIFYING AIR IN RESIDENTIAL BUILDINGS

CROSS-REFERENCE TO RELATED APPLICATIONS

This application claims priority to U.S. Provisional Application No. 61/757,417 and to European Application No. 13159536.5, filed on Mar. 15, 2013, 2012. These applications are herewith incorporated by reference in their entirety.

TECHNICAL FIELD OF THE INVENTION

The present invention relates to a ventilation device, in particular for heating, cooling and/or humidifying air in residential buildings, comprising a duct-shaped housing having an air inlet opening and an air outlet opening and a fan impeller arranged in the housing, with a fan impeller driven by an electric motor, as well as a filter unit, heat exchange unit and/or heating coil unit arranged in the main flow direction of an air flow generated by the fan impeller from the air inlet opening toward the air outlet opening.

BACKGROUND OF THE INVENTION

Such ventilation devices are, for example, also known from EP 1 924 772 B1, GB 1 256 625, DE 30 10 071 A1 and DE 32 41 860 C3. Such ventilation devices are used as so-called air handling units (AHUs) for air treatment, for example, to heat, cool and/or humidify air in residential buildings. They consist of, among other things, a fan which blows or suctions air through the filter, the heat exchanger and/or the heating coil. Such units suction air from one or several ducts that are connected to different rooms in a residential building and, at the outlet of the device, blow the air into a duct system which directs the treated air to different living areas. From the fluidic perspective, these known ventilation devices are characterized in that they consist of a fully closed duct through which the air is directed in the axial direction from the air inlet opening to the air outlet opening. The fan provided in the duct, consisting of the electric motor and the fan impeller, is used to overcome the pressure drops that occur in the duct system. The fan driven by the electric motor represents a substantial electrical load because it requires a considerable electrical input capacity. Furthermore, the heating, cooling and/or air humidifying units generate high flow drops. Furthermore, the known ventilation devices generate a quite significant running noise. Double flow fans with forward curved radial impellers are in particular used in the known devices. An asynchronous internal rotor motor is normally used as an electric motor. Due to their construction, the known fans in use, with forward curved blades at their fan impellers, have a relatively low degree of efficiency.

SUMMARY OF THE INVENTION

On the basis of the ventilation devices described above, it is the underlying object of the present invention to provide a ventilation device which makes a compact and cost-effective design possible, and where an improved degree of efficiency with the capacity is achieved by reducing the input power. In addition, the emitted noise should be as low as possible.

Furthermore, it is the underlying object of the invention to minimize the air inflow turbulence, and in consequence the low-frequency noise, especially the blade passing noise, as well as the pressure drop of the commutator.

According to one aspect of the present invention, this object is attained in that the electric motor is configured as a permanently excited electronically commutated synchronous motor, and the fan impeller as a single flow, free running diagonal impeller or single flow, free running radial impeller with blades bent backward relative to the direction of movement of the impeller. In this case, it is in particular advantageous, if the electric motor is manufactured as an external rotor motor. As the fan impeller according to the present invention is configured as a free running fan impeller, the fan impeller as such is not enclosed by a housing. The permanently excited electronically commutated synchronous motor is characterized by a substantially reduced input power compared to the known asynchronous motors, without thereby resulting in a reduction in the air flow capacity. In addition, the noise emission is reduced by the configuration according to the present invention, and the complexity of the complete fan is simplified, resulting in a reduction in the weight of the components.

It is furthermore advantageous, if the bar structure is formed by a grid structure consisting of intersecting grid bars having a plurality of grid openings enclosed by the grid bars.

The invention is based on the knowledge that the embodiment of the grid structure according to the present invention homogenizes the inflow by reducing turbulence. Velocity fluctuations perpendicular to the main flow direction are prevented by the walls formed by the grid bars. This influence can be controlled via the distance between the walls, whereby it is important that the pressure drop caused by the grid structure according to the present invention is minimized. According to the present invention, it is in particular advantageous that the inlet opening does not have any bars because pressure drops are thus prevented in this area.

Advantageous embodiments of the invention will be described in more detail by means of the exemplary embodiments shown in the attached drawings. The drawings are provided for purely illustrated purposes and are not intended to limit the scope of the present invention.

DETAILED DESCRIPTION OF THE DRAWINGS

Figure 1:
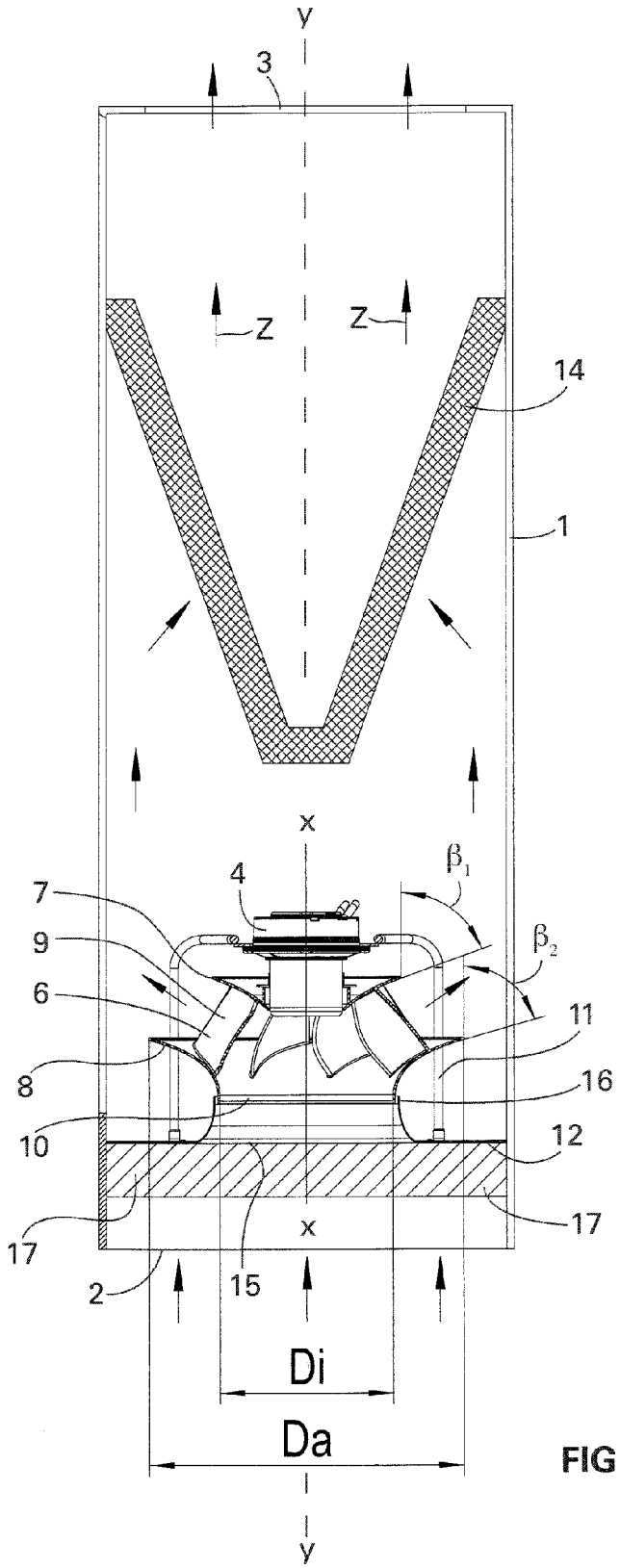
FIG. 1 shows a lateral view of a ventilation device according to the present invention open on one side.

In FIGS. 1 to 16 identical parts and/or functionally similar parts are always designated with the same reference numerals. Insofar as certain features of the inventive ventilation device are described only in connection with an exemplary embodiment, they are, however, also independent of the inventive exemplary embodiment as individual characteristics or in combination with other features of the exemplary embodiment.

As is apparent from FIG. 1, a ventilation device according to the present invention consists of a duct-shaped housing 1, which has a preferentially rectangular, in particular square cross-section. In this case, two housing edges B, T run opposite and parallel to one another, see FIG. 3. These lateral edges B, T respectively have a length $L_B$, $L_T$. The housing 1 has an air inlet opening 2 at one end and an air outlet opening 3 at the opposite end. The housing 1 extends in a duct-like manner in the longitudinal direction from the air inlet opening 2 to the air outlet opening 3. A fan impeller 6 driven by an electric motor 4 is arranged inside the housing 1. In the exemplary embodiment according to FIG. 1, the fan impeller 6 is configured as a diagonal impeller. In the exemplary embodiments according to FIGS. 2 to 4, the fan impeller 6 is configured as a radial impeller.

The electric motor 4 is manufactured as a permanently excited commutated synchronous motor, in particular as an external rotor motor. Such a permanently excited commutated synchronous motor is characterized by a low electric input power, the use of such a motor resulting in significant energy efficiency.

The fan impellers 6 according to FIGS. 1 to 4 are configured as free running, single flow impellers, having blades 9 that are curved backward to the direction of movement of the impeller. The fan impellers 6 according to FIGS. 1 to 4, namely the diagonal impeller according to FIG. 1 or the radial impeller according to FIGS. 2 to 4 have a bottom plate 7 and a cover plate 8, between which the blades 9 are arranged, a central air suction opening 10 being provided in the cover plate 8. The fan arrangement formed by the electric motor 4 and the fan impeller is fastened on an assembly plate 12 by means of a bracket 11. The bracket 11 is fastened on the stator of the electric motor 4 on the one side and on the assembly plate 12 on the other side. The electric motor 4 and the fan impeller 6 have a rotation axis X-X which is perpendicular to the assembly plate 12. In addition, the rotation axis X-X is advantageously coaxial to the central longitudinal axis Y-Y of the duct-like housing 1, and the course of the longitudinal axis Y-Y also coincides with the Z direction of the main air flow generated by the fan impeller 6 within the housing 1. The main flow direction is indicated by the arrow Z.

In the shown exemplary embodiment, a filter unit, a heat exchange unit and/or a heating coil unit 14 is arranged between the ventilator unit composed of the electric motor 4 and the fan impeller 6 and the air outlet opening 3, through which the air flow passes in the main flow direction Z. It is likewise within the scope of the invention, if the fan arrangement composed of the electric motor 4 and the fan impeller 6 is arranged between the unit 14 and the outlet opening 3.

The assembly plate 12 has a flow inlet opening 15 arranged coaxially to the air suction opening 10, whose diameter is preferentially greater than that of the air suction opening 10 of the impeller 6, and a suction nozzle 16 is arranged between the flow inlet opening 15 and the air suction opening 10 which causes the air flow entering the fan arrangement to be smoothed. The fan impeller 6 configured as a diagonal impeller or radial impeller can be provided with blades 9 which have angular divisions uniformly or irregularly distributed over the periphery of the fan impeller 6. The number of blades 9 preferentially is five to thirteen, and in particular, there is an uneven number of blades 9. The fan impeller 6 preferentially is configured as a plastic injection molded part. According to the present invention, it is likewise possible to manufacture the fan impeller 6 of metal. For fire protection reasons, materials which comply with the respective fire protection policies, which can be country-specific, are used for manufacturing the fan impeller 6.

In the case of the fan impeller 6 configured as a diagonal impeller shown in FIG. 1, the bottom plate 7 and the cover plate 8 are configured such that their plate surface enclose an acute angle β1 or β2 relative to the rotation axis X-X of the impeller, where β1 and β2 are ≥60° and ≤80°. In this case, β1 is assigned to the bottom plate 7 and β2 to the cover plate 8. The fan impeller 6 has an external diameter Da, and the air suction opening 10 in the cover plate 8 has a diameter Di. According to the present invention, the ratio between the diameter Di and the external diameter Da, that is, Di:Da advantageously is ≥0.44 and ≤0.85. The smallest edge LB or Lt of the edges B, T of the housing 1 relative to the maximum external diameter Da of the diagonal impeller 6, that is, Min(B. T)/Da is ≥1.05 and ≤2. In the case of the radial impeller shown in FIGS. 2 to 4, this ratio is Min(B, T)/Da 1.2 to 2. The fan impellers 6 configured as diagonal impellers or radial impellers advantageously have a non-rotationally symmetric bottom and/or cover plate 7, 8. It is also advantageous if the electric motor 4 of the air suction opening 10 is arranged on the opposite side behind the bottom plate 7, and that a rounded flow contour of the bottom plate 7 is configured from a front side of the electric motor 4 facing the air suction opening 10 up to an external outlet edge of the bottom plate 7.

Figure 2:
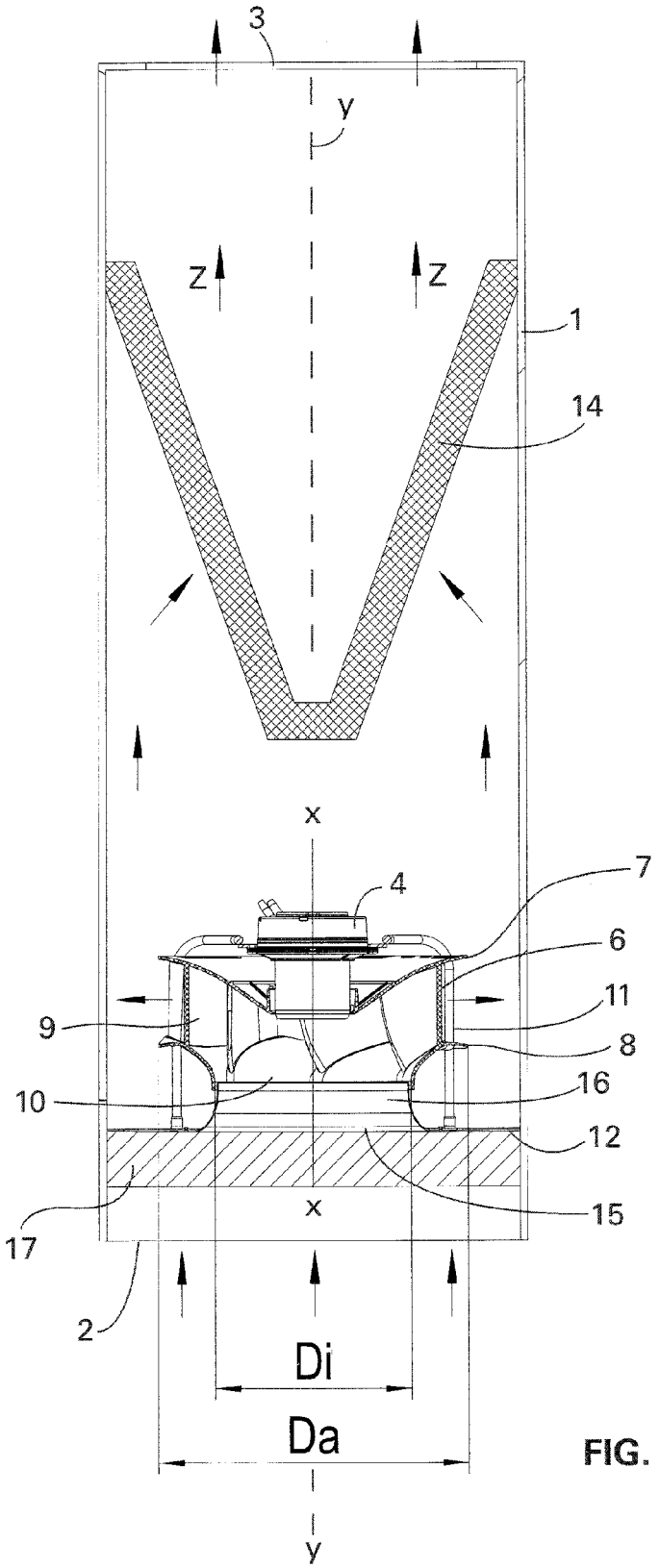
FIG. 2 shows a lateral view of another embodiment of a ventilation device according to the present invention with the housing open on one side.
Figure 3:
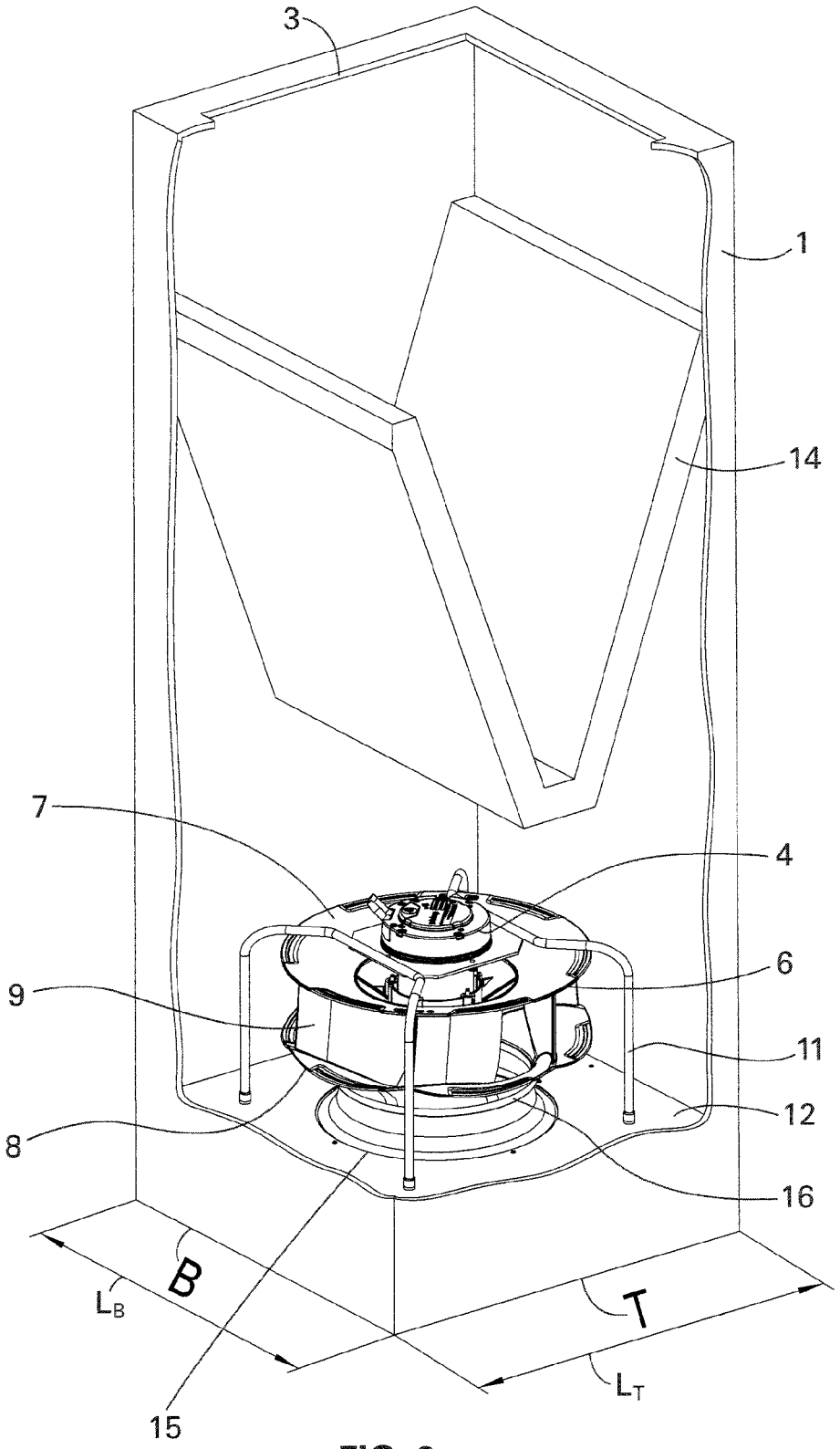
FIG. 3 shows a perspective view of the embodiment according to the present invention according to FIG. 2.
Figure 4:
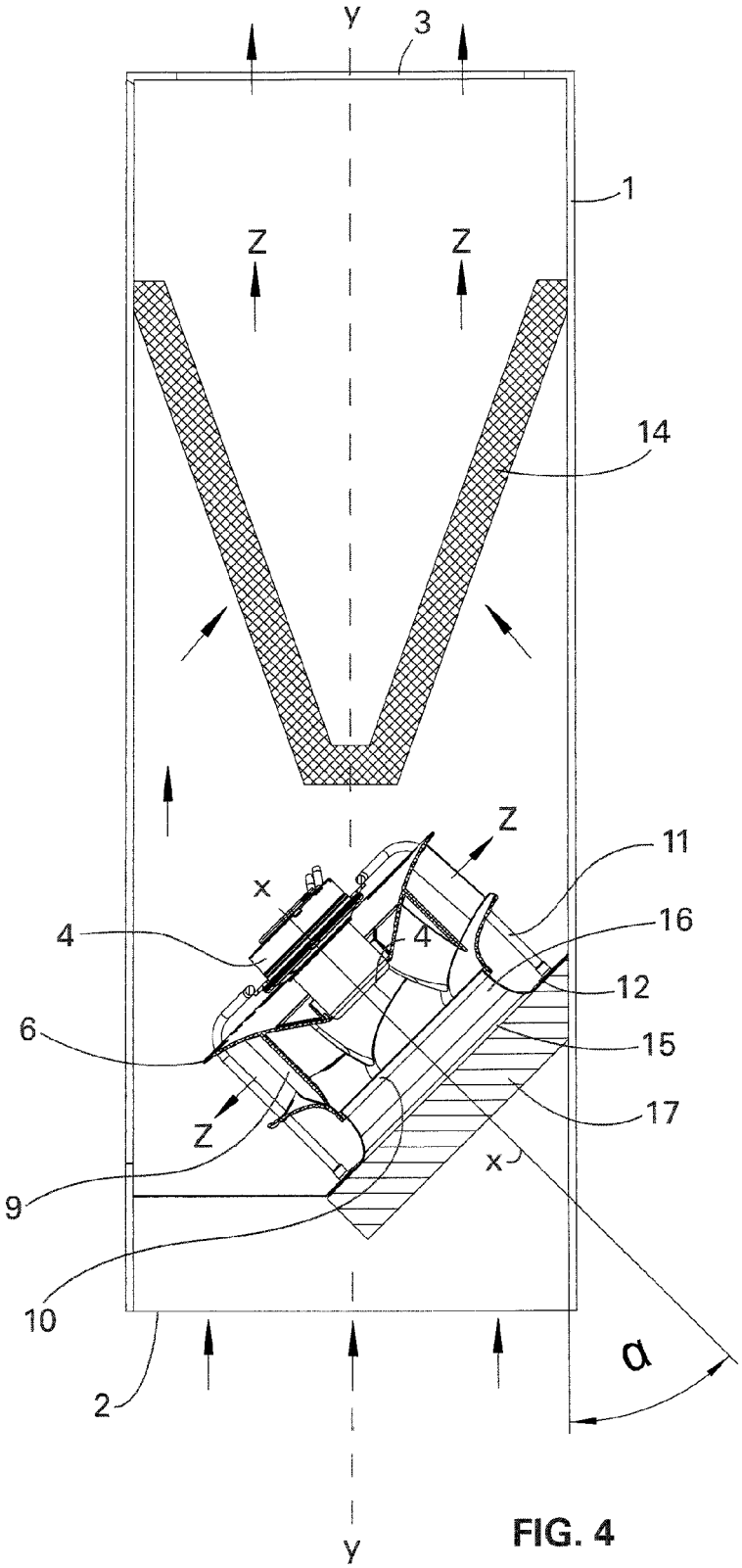
FIG. 4 shows a lateral view of another embodiment of a device according to the present invention with the housing open on one side.

In FIGS. 2 to 4, the fan impeller 6 is configured as a radial fan impeller. In the embodiment shown in FIG. 2, the fan arrangement formed by the electric motor 4 and the fan impeller 6, as already described in relation to FIG. 1, is fastened on the assembly plate 12 by means of the bracket 11, where the fastening is such that the rotation axis X-X is perpendicular to the assembly plate 12. With regard to the configuration of the assembly plate 12 and the arrangement of a suction nozzle 16, they are configured and arranged in accordance with the embodiment shown in FIG. 1. FIG. 3 shows a perspective view of the ventilation device according to the present invention shown in FIG. 2. FIG. 4 shows an embodiment in which the rotation axis X-X of the impeller 6 encloses an angle α with the central longitudinal axis Y-Y, which is >0, preferentially 45° in the shown example. In this case, the assembly plate 12 is divided in two sections, namely a section that is perpendicular to the longitudinal axis Y-Y and a section at an angle>0, in particular, by way of example, at an angle of 45° relative to the longitudinal axis Y-Y. The fan arrangement consisting of the electric motor 4 and the fan impeller 6 is fastened by means of the bracket 11.

It is furthermore advantageous if a guiding device 17 is arranged in the direction of the air flow Z in front of the inflow opening 15, for example, underneath the assembly plate 12. This guiding device 17, which forms a flow conditioner according to FIGS. 5 to 16, is used to prevent additional noise in case of inflow disturbances. The filter unit, heat exchange unit and/or heating coil unit 14 arranged in the duct-shaped housing 1 can either be arranged perpendicularly or, to increase the surface area, at an angle of <90° relative to the main flow direction Z. In the shown exemplary embodiment, this device is shown with a V-shaped configuration, which results in a particularly large contact area.

Figures 5, 6:
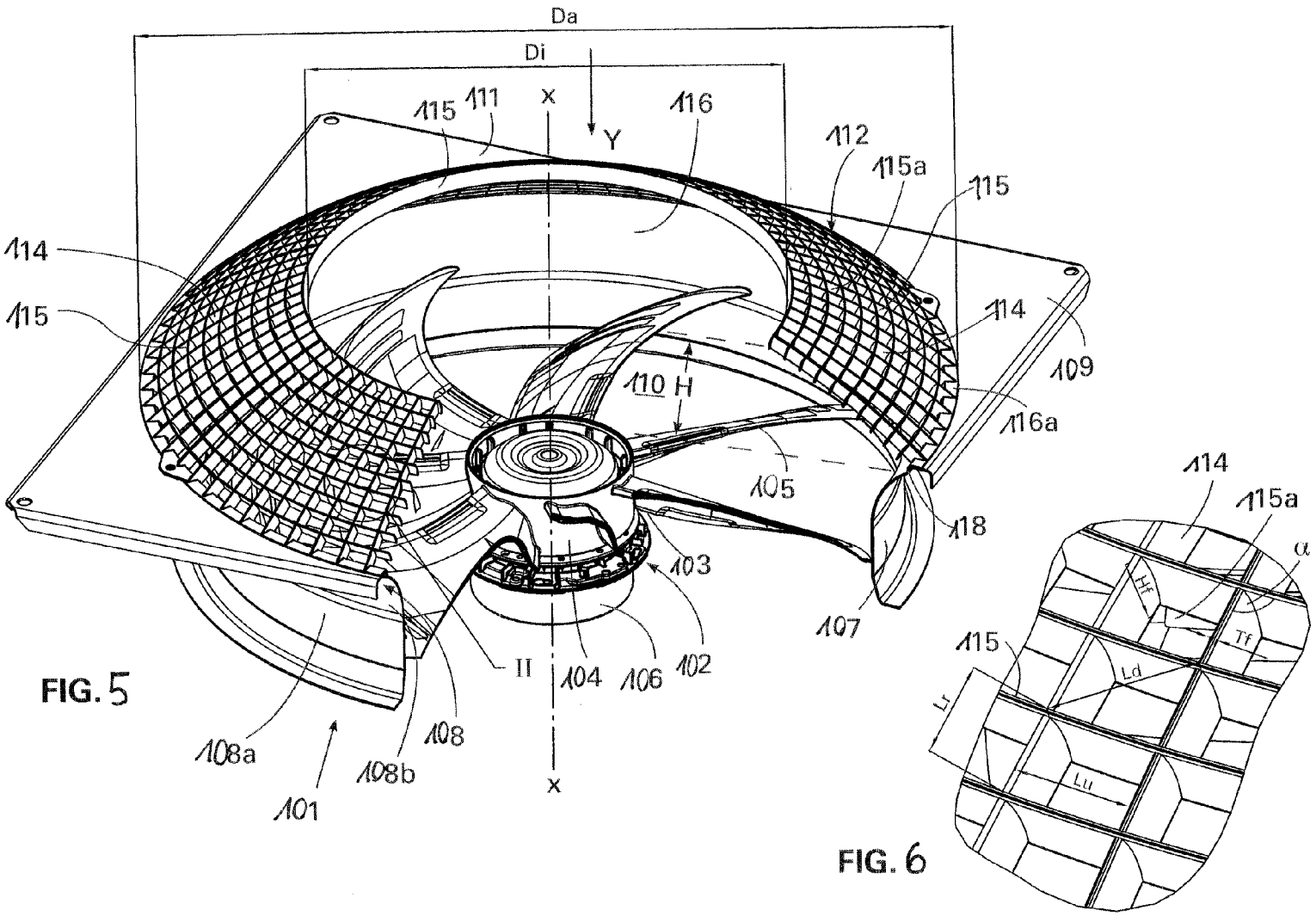
FIG. 5 shows a partial sectional perspective view of a flow conditioner according to the present invention.
FIG. 6 shows a detailed view of II in FIG. 5.
Figure 8:
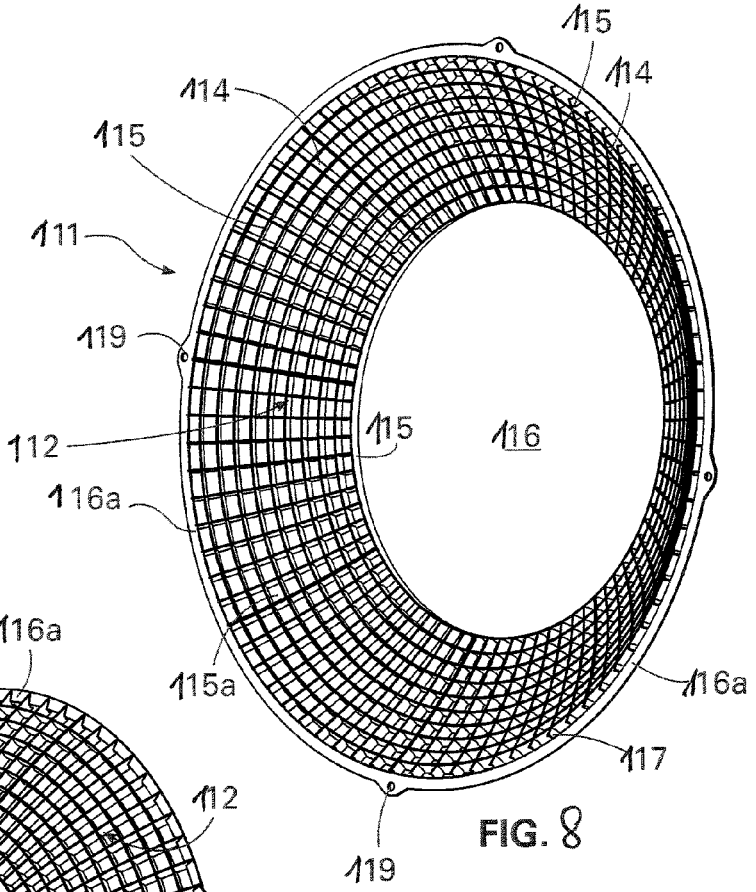
Figure 7:
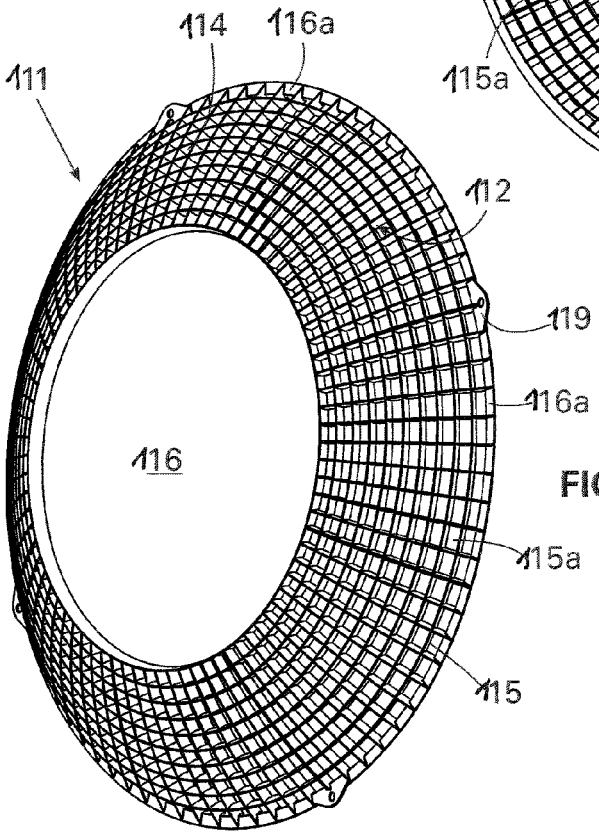
FIG. 7 shows a perspective view of a flow conditioner according to the present invention shown in FIG. 5, FIG. 8 a perspective view of the back of the flow conditioner according to FIG. 7, FIG. 9 another embodiment of a fan arrangement with a flow conditioner according to the present invention, FIG. 10 a perspective front view of the flow conditioner according to the present invention shown in FIG. 9, FIG. 11 a perspective view of the back of the flow conditioner according to FIG. 10, FIG. 12 a perspective view of another embodiment of a flow conditioner according to the present invention, FIG. 13 a perspective back view of the flow conditioner according to the present invention shown in FIG. 12, FIG. 14 a partial sectional perspective view of the flow conditioner according to the present invention shown in FIG. 12, FIG. 15 measured noise power curves depending on the A-level, and FIG. 16 a typical installation situation of a fan for the measurement of the noise power.

FIG. 5 shows a ventilation arrangement having an axial fan 102 which has a blade impeller 103 and a central hub 104 and radial blades 105 relative to a central longitudinal axis X-X fastened to the periphery of the hub 104. The central longitudinal axis X-X coincides with a rotation axis of the hub 104, said hub 104 being in particular configured as an external rotor of an electric external rotor motor 106.

The impeller 103 is peripherally enclosed by a preferentially circular cylindrical housing ring 107, on which an annular suction nozzle 108 is provided on the suction side at a flow inlet opening 110 of the housing ring 107 that can preferentially be configured in one piece with the housing ring 107. An assembly plate 109 is arranged in the suction direction Y in front of the suction nozzle 108 that encloses the flow inlet opening 110. A flow conditioner 111 according to the present invention is fastened in the direction Y in front of the flow inlet opening 110. This flow conditioner 111 has a grid structure 112 consisting of intersecting bars, namely in particular axial bars 114 which extend in the direction of the longitudinal axis X-X and consist of annular peripheral bars 115 extending concentrically to the longitudinal axis X-X. This grid structure 112 has grid openings 115*a* between the axial bars 114 and the peripheral bars 115. The grid structure 112 according to the present invention forms a geometrical body, which, in the shown exemplary embodiment, has the shape of a truncated cone, whose base encloses the inflow opening 110 and whose end face opposite the base comprises or has an inlet opening 116. The geometrical body may alternatively the shape of an n-sided truncated pyramid, whose base has the flow inlet opening 110 and whose end face opposite the base has the guide inlet opening 116, n being a whole number greater/equal to 3. It is advantageous, if the axial bars 114 enclose an angle α of 90°±10% deviation with the peripheral bars at their intersections. In the shown exemplary embodiment, the grid openings 115*a* are rectangular, namely in particular with curved peripheral sides which are formed in sections by the peripheral bars 115. The grid openings 115*a* can, however, also have a different polygonal or oval shape. In the shown exemplary embodiment, the lateral surface of the truncated cone-shaped body, which is formed by the grid structure 112, is convexed outward viewed longitudinally across its longitudinal axis X-X.

According to the present invention, it can likewise be advantageous if the lateral surface of the truncated cone-shaped body of the grid structure 112 is concaved inward or also has a rectilinear course. In the shown exemplary embodiment, an inlet opening 116 is configured centrally and centered relative to the longitudinal axis X-X in the grid structure 112. This inlet opening 116 has no bars. In the assembled state, the grid structure 112 preferentially lies flat against the assembly plate 109 with a peripheral annular rim 116*a*, so that the rim 116*a* is integrally molded such that it is parallel to the assembly plate 109 in the assembled state, that is, it is perpendicular to the longitudinal axis X-X. The axial bars 114 extend from the rim 116*a* against the suction direction Y in the direction of the inlet opening 116. The axial bars 114 preferentially have extensions 117 with which they encompass the flow inlet opening 110 in its rim area 118 in the assembled state, see FIG. 8. The central, in particular bar-free inlet opening 116 has an internal diameter $D_i$, in particular holding $D_i \geq D_{lf} \times 0.55$, the diameter $D_{lf}$ being the maximum diameter of the impeller. The bars, that is, the axial bars 114 and the peripheral bars 115 of the grid structure 112 preferentially have a height $H_f$ and a thickness $T_f$, holding $H_f/T_f > 5$. The grid openings 115*a* have an axial grid width $L_r$ and a peripheral grid width $L_i$, preferentially holding $1/3 < L_u/L_r < 3$. In this case the grid openings 115*a* have a diagonal opening width $L_d$, which is in particular measured such that $0.01 < L_d/D_{lf} < 0.15$ holds, $D_{lf}$ being the diameter of the impeller, that is, of the blade impeller 103. The axial height H of the inlet opening 116 relative to the base of the grid structure 112 or assembly plate 109 is calculated from $0.05 \leq H/D_{lf} \leq 0.5$. According to the invention, the axial height H can also be zero, so that it is a flat commutator arrangement.

Advantageously, the axial bars 114 always have the same peripheral angular distance to one another, and the peripheral bars 115 advantageously always have the same axial distance to one another. It is likewise within the scope of the invention, if the diagonal opening width $L_d$ and/or the ratio $L_u/L_r$ varies over the radius and/or the periphery of the grid structure 112. Areas of the grid structure 112 can also be configured open so that there are no bars. It is furthermore within the scope of the invention, if the axial bars 114 and/or the peripheral bars 115 are not uniformly but irregularly distributed inside the grid structure 112 according to the present invention.

The inlet opening 116 of the flow conditioner 111 is advantageously enclosed by a peripheral bar 115, so that the axial bars 114 end at this peripheral bar 115. Fastening lugs 119 with openings are integrally molded on the external rim 116*a*, the flow conditioner 111 being fastened on the assembly plate 109 by means of fastening means, which are not shown, and the fastening lugs 118 [sic, 119].

Figure 9:
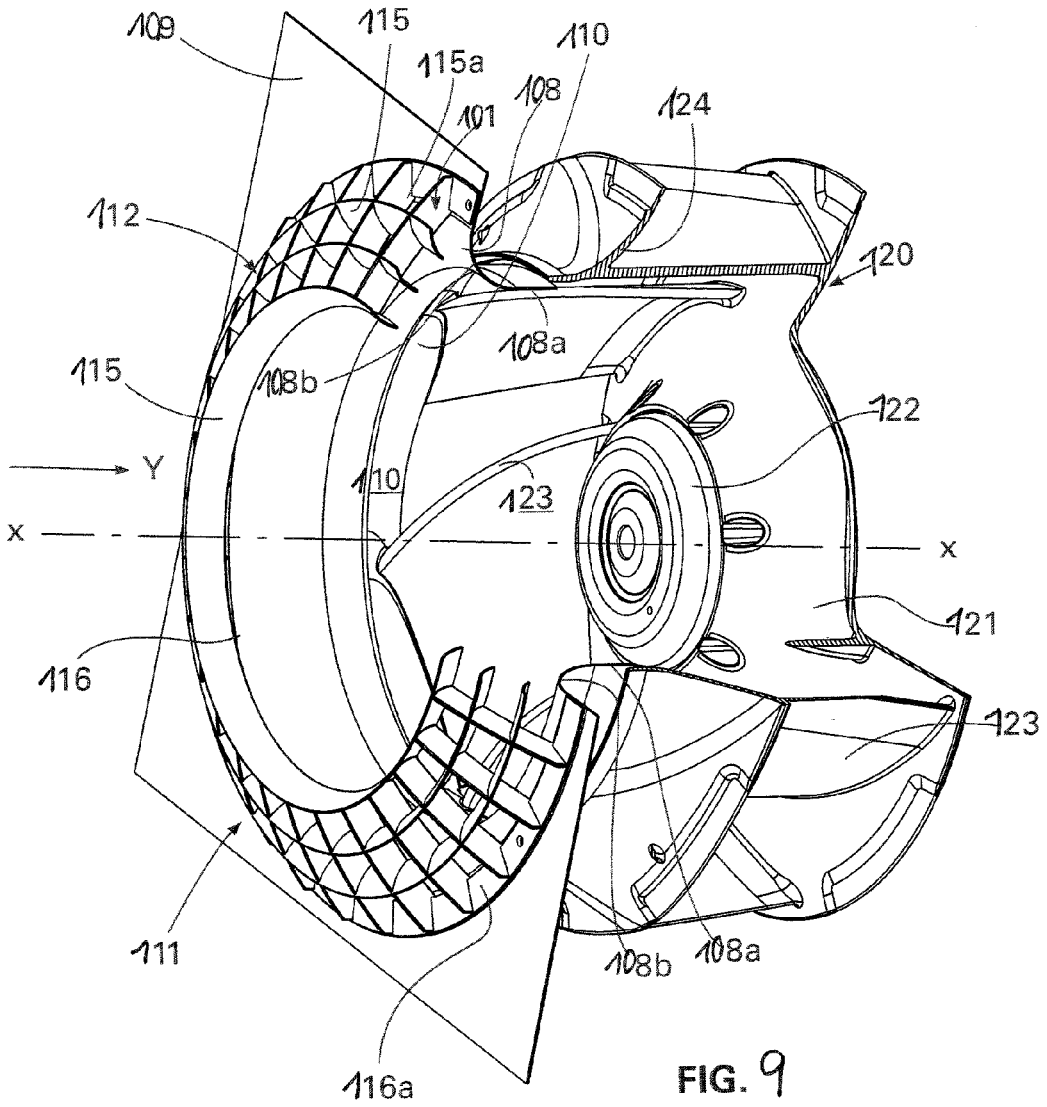

FIG. 9 shows a fan arrangement 1 which has a radial fan 120. It has a blade impeller 121 with a central hub 122. Blades 123 are attached to the hub 122. The rotation axis of the hub 122 coincides with the central longitudinal axis X-X of the fan arrangement 1. An electric external rotor motor, whose rotor simultaneously forms the hub 122, is advantageously used as a drive.

The blade impeller 121 consists of, among other things, a cover plate 124. An annular suction nozzle 108 is arranged on it on the suction side at the flow inlet opening 110, which is enclosed by the cover plate 124. This suction nozzle 108 is, as well as in FIG. 5, formed by a cylindrical section 108*a*, which, in the shown example, is adjacent to the cover plate 124 and can be connected with a partial section to the assembly wall 109 and to a nozzle section 108*a* that enlarges in an arch-shaped manner extending up to the assembly wall 109. As described in relation to FIG. 5, a flow conditioner 111 according to the present invention is arranged in the suction direction Y in front of the flow inlet opening 111, also see FIG. 10. It consists of axial bars 114 and peripheral bars 115, wherefore full reference is made to the description of FIGS. 5 to 8, as well as entirely to the measurements indicated in relation to the dimensions of the bars, that is, the axial bars 114, and of the peripheral bars, as well as to the dimensions of the grid openings 115*a*.

Figure 11:
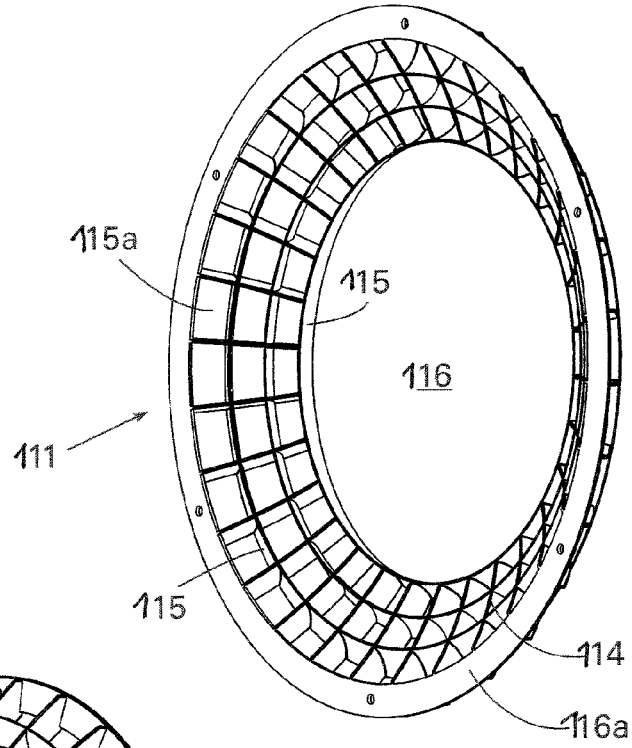
Figure 10:
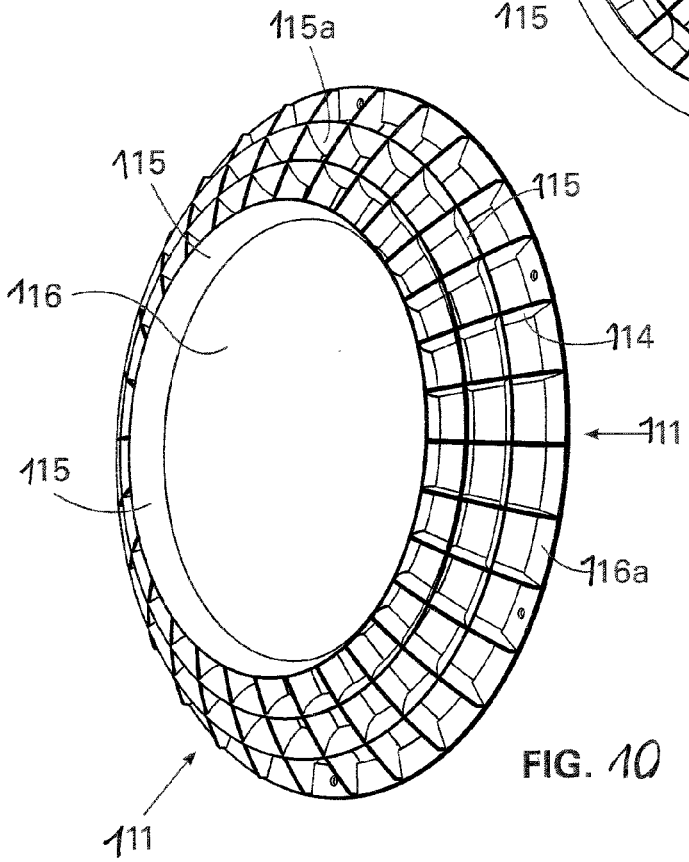

As is apparent from FIGS. 9 to 11, the flow conditioner 111 can be fastened with its peripheral rim 116*a* on the assembly plate 109 fully lying against it, wherefore openings 119 for fastening means are provided in the rim 116*a*.

Figure 14:
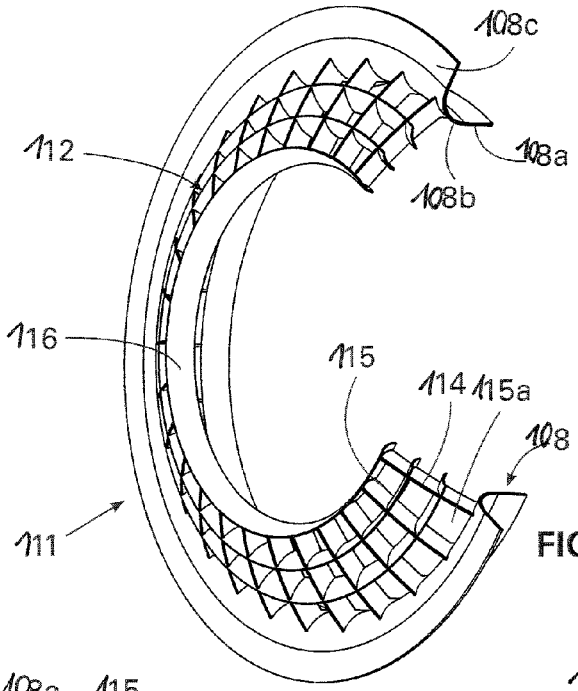
Figure 12:
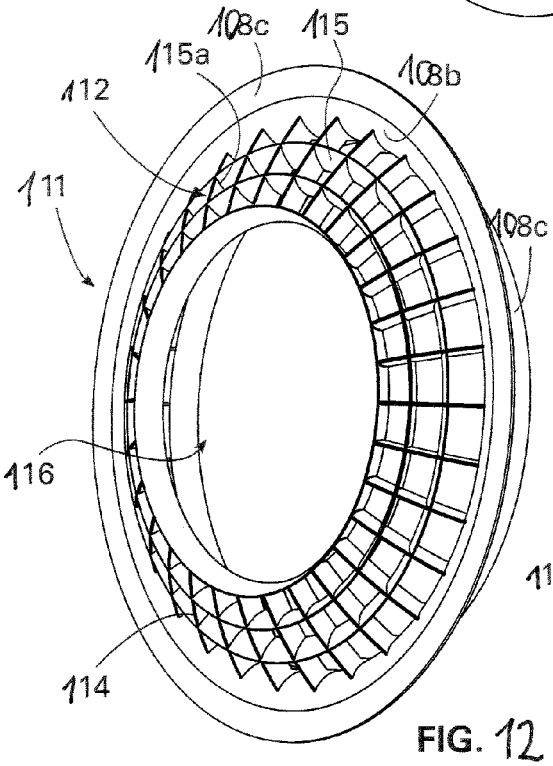
Figure 13:
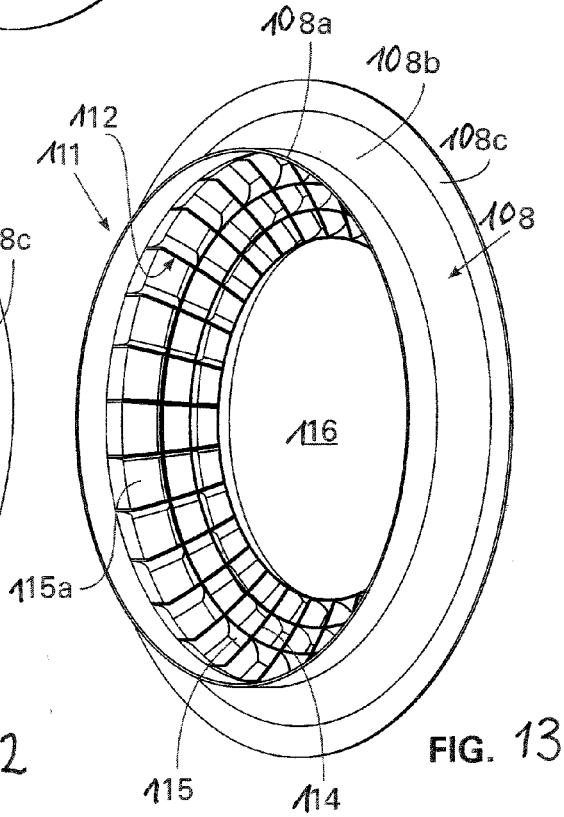

FIGS. 12 to 14, show another embodiment of a flow conditioner 111 according to the present invention, in which the flow conditioner 111 is configured in one piece with the suction nozzle 108. In this embodiment, the rim 116 according to FIGS. 9 to 11 can be omitted, and the axial bars 114 are directly connected with their ends to the suction nozzle 108 in the area of the nozzle section 108*b*. In this variant, the suction nozzle 108 has an annular flange section 108*c* at the section 108*b* which can directly be fastened on the assembly plate 109.

The flow conditioner 111 according to the present invention can be made in one or several parts by injection molding or die casting. These individual parts can be riveted, stuck or screwed together. A snap connection would also be possible within the scope of the invention. If the parts in the flow conditioner according to the present invention are made of metal, they can also be manufactured by blanking. As is, in particular, described in relation to FIGS. 12 to 14, the flow conditioner 111 according to the present invention, can also be connected to the suction nozzle section or to an inlet ring of a housing of the fan arrangement according to the present invention or screwed, stuck or riveted together with the wall ring or joined by means of a clip connection. A welded joint could also be possible. The grid structure 112 according to the present invention can consist of plastic, metal or also of composites. According to the present invention, it can likewise be advantageous, if the flow conditioner 111 according to the present invention is provided with a fire protection coating. It is likewise possible to correspondingly select the material such that the fire protection conditions are met.

The grid bars, in particular the axial bars 114 and the peripheral bars 115 of the grid structure 112 according to the present invention, are advantageously configured and arranged such that the flow from the flow conditioner 111 is swirl-free, or that no swirl is conveyed to the flow by the grid structure 112. It is likewise within the scope of the invention if the internal diameter $D_i$ of the inlet opening 110 varies over the periphery of the opening. In order to provide protection against accidental contact it can likewise be advantageous if the inlet opening 110 is closed by a protection grid. As far as advantageous, in particular for assembly reasons, the flow conditioner 111 according to the present invention can also be fastened on the suction side directly on a supporting or protection grid of a fan arrangement. The inlet opening 116 can also receive further elements, provided their total flow surface is not larger than 15% of the surface of the inlet opening 116. It is thus possible, by way of example, that a mount for the assembly of the fan is provided inside the inlet opening 116.

Compared to the prior art described above, a significant reduction in the rotational noise of the fan results, namely in the non-installed state as well as in the installed state. In addition, there is a significant reduction in the assessed noise power level in the installed state, with no, or only a minimum decrease in efficiency.

Figure 15:
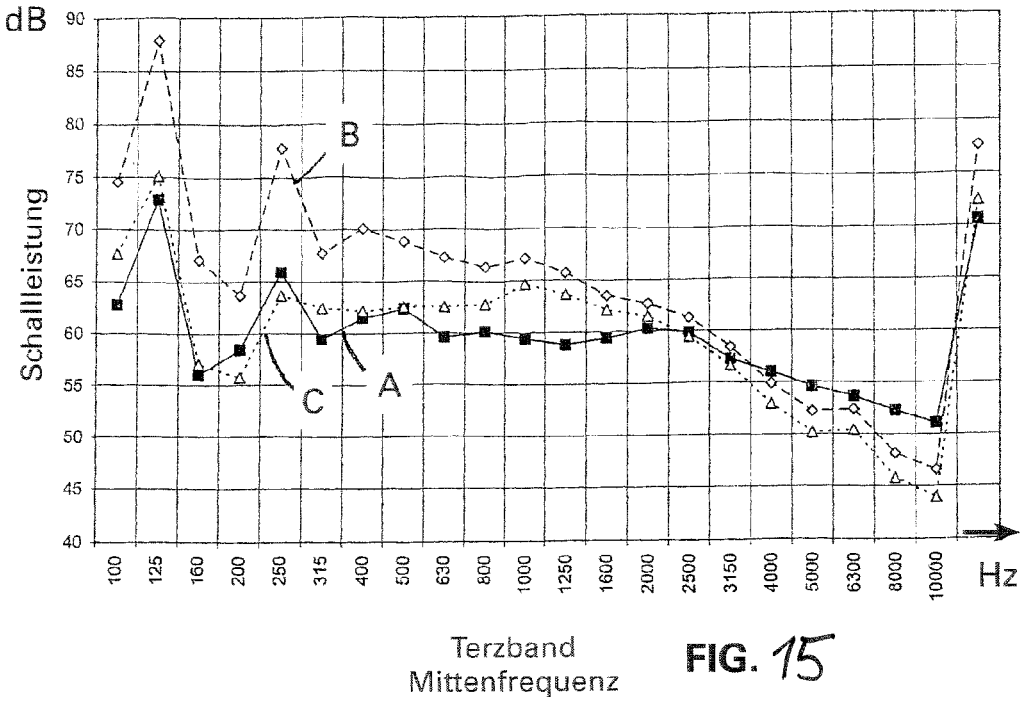

As is apparent from FIG. 15, a significant noise advantage is achieved by using a flow conditioner according to the present invention. Curve A shows a third-octave band of the acoustic power on the suction side of an axial fan at a flow rate of 14400 $m^3$/h and a pressure of 58 Pa. The number of revolutions is 1020 1/min with undisturbed flow under laboratory conditions. Undisturbed flow is in this case understood as a flow with a uniform velocity field in terms of time and space having a degree of turbulence smaller than 1%.

Figure 16:
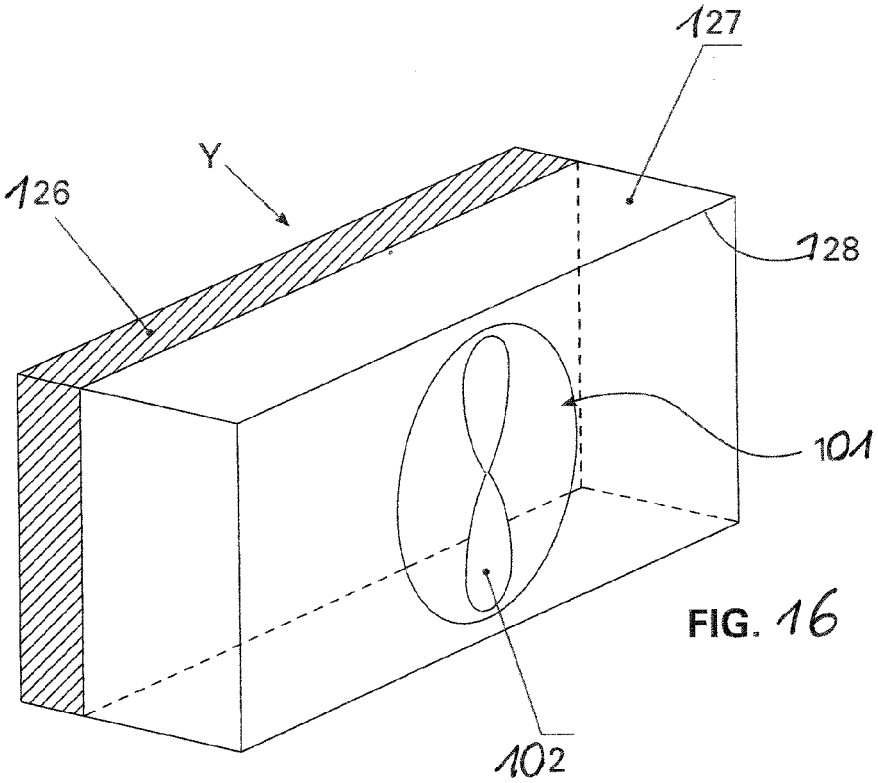

A typical schematic installation situation of the same fan 102 is a client's device, where the fan suctions air via a heat exchanger 26, and where there is a free space 127 between the heat exchanger 126 and the fan 102, as shown in FIG. 16. There is usually a protection grid behind the axial fan, which is not shown here. The heat exchanger has the following dimensions: length 141 cm×height 153 cm×depth 17 cm; the pressure drop is 58 Pa at 14400 $m^3$/h. The box 128 or free space 127 has the same height and length with a depth of 38 cm.

By means of this installation, the flow in the fan is disturbed by an irregular velocity field in terms of time and space. In addition, the inflow turbulence is significantly increased. Curve B displays this case, from which it is apparent that the noise from the fan is strongly increased, namely in particular at low frequencies. By using a flow conditioner according to the present invention with the following dimensions: external diameter 795 mm, internal diameter 464 mm, height 130 mm; $L_d/D_{if}$=4.3%; 15 peripheral struts and 120 axial struts 114, strut depth 17 mm and strut thickness 1.5 mm, the noise level is again adapted to the noise level of the undisturbed flow (curve A), wherefore reference is made to curve C. By using a flow conditioner according to the present invention, a disturbed inflow in terms of time and space is again homogenized and the turbulence is significantly reduced. This clearly causes a reduction in noise, so that by using a flow conditioner according to the present invention the flow can again be made substantially approximate to the undisturbed flow. A flow conditioner according to the present invention thus has important advantages in terms of noise.

By means of the embodiment of the ventilation device according to the present invention, the electric power input can be strongly reduced and likewise the noise emission; in particular, the emission of rotational noise is reduced by the guiding device used. In addition, the complexity of the fan composed of the electric motor 4 and the fan impeller 6 is strongly simplified and the weight of the components reduced compared to the prior art described above. In this case, it is in particular advantageous if, according to the present invention, the fan arrangement consisting of the electric motor 4 and the fan impeller 6 as well as the suction nozzle 16 and the bracket 11 form a subassembly unit, which can be inserted preassembled into the housing 1 without any auxiliary devices.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. In particular, elements or features of one embodiment may be may be combined with or replace elements or features of a different embodiment. All such modifications and variations are within the scope of the invention as determined by the appended claims when interpreted in accordance with the breadth to which they are fairly, legally, and equitably entitled.

The invention claimed is:

1. A ventilation device for residential buildings, comprising a duct-shaped housing (1) having an air inlet opening (2) and an air outlet opening (3) and a fan impeller (6) driven by an electric motor (4) arranged in the housing (1), as well as a filter unit, and at least one of a heat exchange unit and a heating coil unit (14) arranged in a main flow direction (Z) of an air flow generated by the fan impeller (6) from the air inlet opening (2) toward the air outlet opening (3), wherein the electric motor (4) is configured as a permanently excited electronically commutated synchronous motor, and the fan impeller (6) as a single flow, free running impeller with blades (9) bent backward relative to a direction of movement of the impeller, an air guiding device (17) being arranged in the main flow direction (Z) of the air flow in front of a suction nozzle (16, 108), the air guiding device (17) being configured as a flow conditioner, comprising a bar structure (112) composed of air guiding bars (114) to be fastened on the suction side in front of a flow inlet opening (15, 110) with a central longitudinal axis (X-X) of the fan arrangement (100), which encloses the flow inlet opening (15, 110) such that a guide inlet opening (116) is configured on the suction side at an axial height (H) in front of the flow inlet opening (15, 110) of the bar structure (112) whose opening surface is smaller than the flow inlet opening (15, 110), the bar structure being formed by a grid structure (112) consisting of intersecting grid bars (114, 115) having a plurality of grid openings (115 *a*) enclosed by the grid bars (114, 115), the grid bars (114, 115) of the grid structure (112) having a height (Hf) and thickness (Tf) holding Hf/Tf>5 and the grid openings (115 *a*) having an axial grid width Lr and a peripheral grid width Lu, holding: ⅓<Lu/Lr<3 for all of the grid openings, wherein the grid openings (115 *a*) have a diagonal opening width Ld and the fan impeller (6) has an external diameter Da with 0.01<Ld/Da<0.15 for all of the grid openings, wherein in the direction of the flow inlet opening (110) to the guide inlet opening (116) the grid structure (112) is formed by axial bars (114) which are intersecting peripheral bars (115) angled (a) at 90°±10% deviation;

wherein each of the axial bars (114) extends from the guide inlet opening (116) to an outer peripheral annular rim (116 *a*) extending around the grid structure, and wherein the air guiding device has a frustoconical shape and each of the peripheral bars is axially offset from the other peripheral bars.

2. The ventilation device according to claim 1, wherein the axial height (H) is calculated from the ratio 0.05≤H/Da≤0.5, Da being the external diameter of the impeller (103) of the fan arrangement (101).

3. The ventilation device according to claim 1, wherein the guide inlet opening (116) is a bar-free, central opening and has an internal diameter Di satisfying the equation $D_i \geq D_a \times 0.55$, with $D_a$ being the outer diameter of the impeller.

4. The ventilation device according to claim 1, wherein the peripheral annular rim (116 *a*) lies flat against an assembly plate (109) of a fan arrangement (1) in the assembled state, so that the rim (116 *a*) is aligned perpendicularly to the longitudinal axis (X-X).

5. The ventilation device according to claim 1, wherein at least one of the diagonal opening width (Ld) and a ratio Lu/Lr of the peripheral grid width Lu divided by the axial grid width Lr varies over at least one of a radial direction and a peripheral direction of the grid structure (112).

6. The ventilation device according to claim 1, wherein the grid structure (112) includes open areas.

7. The ventilation device according to claim 1, wherein the fan impeller (6) is arranged in the housing (1) such that the rotation axis (X-X) encloses an angle (α) greater than 0 with a central longitudinal housing axis (Y-Y) running in the main flow direction (Z).

8. The ventilation device according to claim 1, wherein the number of blades (9) is an odd number in a range of five to 13.

9. The ventilation device according to claim 1, wherein the duct-shaped housing (1) has a rectangular cross-section, with two edges (B, T) opposite and parallel to one another and a ratio between a smallest edge length Min LB,T of the edges (B, T) to the external diameter Da of the fan impeller (6) is Min LB,T:Da=1.05 to 2 if the impeller (6) is diagonal and 1.2 to 2 if the impeller (6) is radial.

10. The ventilation device according to claim 1, wherein the suction nozzle (16) is in the air flow direction (Z) in front of the air suction opening of the cover plate (8).

11. The ventilation device according to claim 10, wherein the grid openings (115 *a*) have a polygonal or an oval shape.

12. The ventilation device according to claim 1, wherein the axial bars (114) are connected to one of the peripheral bars (115) and to the outer peripheral annular rim (116 *a*).

13. The ventilation device according to claim 12, wherein the guide inlet opening (116) of the flow conditioner (111) is enclosed and delimited by one of the peripheral bars (115), so that the axial bars (114) end at the one of the peripheral bars.

14. The ventilation device according to claim 1, wherein the electric motor (4) is configured as an external rotor motor.

15. The ventilation device according to claim 14, wherein an angular distance between the axial bars (114) is equal.

16. The ventilation device according to claim 14, wherein an axial distance between the peripheral bars (115) is equal.

17. The ventilation device according to claim 1, wherein the impeller (6) has a bottom plate (7) and a cover plate (8), between which the blades (9) are arranged, a central air suction opening (10) being provided in the cover plate (8).

18. The ventilation device according to claim 17, wherein the impeller is a diagonal impeller, wherein the bottom plate (7) and the cover plate (8) of the diagonal impeller (6) each have a plate surface enclosing an acute angle β1 and β2, respectively, with 60°≤β1≤80° and 60°≤β2≤80° relative to the rotation axis (X-X) of the fan impeller (6).

19. The ventilation device according to claim 17,
wherein at least one of the bottom plate (7) and the cover plate (8) is configured rotationally asymmetrical.

20. The ventilation device according to claim 17,
wherein the air suction opening (10) of the cover plate (8) has a diameter Di, and the fan impeller (6) has the external diameter Da, Di and Da having a ratio $0.44 \leq Di:Da \leq 0.75$.

21. The ventilation device according to claim 17,
wherein the electric motor (4) is arranged on an opposite side of the air suction opening (10) behind the bottom plate (7), and that a rounded flow contour of the bottom plate (7) is configured from a front side of the electric motor (4) facing the air suction opening (10) up to an external outlet edge of the bottom plate (7).

22. The ventilation device according to claim 1,
wherein the grid structure (112) forms a lateral surface of a geometrical body.

23. The ventilation device according to claim 22,
wherein the geometrical body has the shape of an n-sided truncated pyramid, whose base has the flow inlet opening (110) and whose end face opposite the base has the guide inlet opening (116), n being a whole number greater/equal to 3.

24. The ventilation device according to claim 22,
wherein the lateral surface of the geometrical body is convexed outward or concaved inward viewed longitudinally across its longitudinal axis (X-X).

25. The ventilation device according claim 22,
wherein the geometrical body has the shape of a truncated cone, whose base has the flow inlet opening (110) and whose end face opposite the base has the guide inlet opening (116).

26. The ventilation device according to claim 25,
wherein the truncated cone-shaped body has a circular end face and base.

* * * * *